US005884593A

United States Patent [19]

Immel et al.

[11] Patent Number: 5,884,593

[45] Date of Patent: Mar. 23, 1999

[54] HEAD AND OVERHEAD CAMSHAFT ASSEMBLY FOR AN INTERNAL COMBUSTION ENGINE

[75] Inventors: Thomas A. Immel, Malone; Erik J. Christiansen, Cedarburg, both of Wis.

[73] Assignee: Tecumseh Products Company, Tecumseh, Mich.

[21] Appl. No.: 842,181

[22] Filed: Apr. 23, 1997

Related U.S. Application Data

[60] Provisional application No. 60/016,262, Apr. 24, 1996.

[51] Int. Cl. [6] ..... F01L 1/26

[52] U.S. Cl. ..... 123/90.23; 123/90.27; 123/90.38; 123/193.5; 123/182.1; 123/196 W

[58] Field of Search ..... 123/90.22, 90.23, 123/90.27, 90.31, 90.38, 90.39, 90.6, 182.1, 193.5, 193.3, 195 HC, 195 C, 196 W

[56] References Cited

U.S. PATENT DOCUMENTS

| | | | |
|---|---|---|---|
| 870,065 | 11/1907 | Welch | 213/90.23 |
| 1,239,933 | 9/1917 | Miller | 123/90.26 |
| 1,267,337 | 5/1918 | Huebotter | 123/90.44 |
| 1,271,354 | 7/1918 | Nus | 123/58.1 |
| 1,708,749 | 4/1929 | Adam | 123/90.2 |
| 2,429,106 | 10/1947 | Paxman | 123/55 |
| 2,466,550 | 4/1949 | Lundquist | 123/52 |
| 2,478,106 | 8/1949 | Jozif | 123/195 |
| 2,766,739 | 10/1956 | Kosche | 123/32 |
| 2,980,089 | 4/1961 | Sampietro | 123/90 |
| 3,672,338 | 6/1972 | Yamanouchi | 123/90.38 |
| 3,757,749 | 9/1973 | Hatz | 123/90.22 |
| 4,660,515 | 4/1987 | Arakawa | 123/90.27 |
| 4,724,805 | 2/1988 | Wirth | 123/90.39 |
| 4,757,789 | 7/1988 | Laine | 123/193.5 |
| 4,811,705 | 3/1989 | Ono | 123/195 |
| 4,977,868 | 12/1990 | Holschuh | 123/182 |
| 5,197,422 | 3/1993 | Oleksy et al. | 123/182.1 |
| 5,213,074 | 5/1993 | Imagawa | 123/196 |
| 5,263,454 | 11/1993 | Imagawa | 123/437 |
| 5,267,536 | 12/1993 | Imagawa | 123/90.23 |
| 5,293,847 | 3/1994 | Hoffman | 123/90.6 |
| 5,357,917 | 10/1994 | Everts | 123/90.39 |
| 5,421,298 | 6/1995 | Ming et al. | 123/193.5 |
| 5,706,769 | 1/1998 | Shimizu | 123/90.23 |

FOREIGN PATENT DOCUMENTS

| | | | |
|---|---|---|---|
| 6-137211 | 5/1994 | Japan | 123/193.5 |
| 2159877 | 12/1985 | United Kingdom | 123/90.23 |

*Primary Examiner*—Wellun Lo
*Attorney, Agent, or Firm*—Baker & Daniels

[57] ABSTRACT

An overhead cam internal combustion engine having a slanted head design which permits the camshaft assembly comprising a camshaft, rocker arms and valve assemblies to be pre-assembled to the head and valve lash to be set off of the main engine assembly line. The slanted head design allows the chain sprocket and timing chain for driving the camshaft to be installed thereon after the head has been assembled to the engine block, accommodating the easy installation of the timing chain. L-shaped rocker arms, mounted on a single shaft, follow a single lobe overhead camshaft. Each rocker arm actuates a valve located on the side of the camshaft opposite that which it follows.

19 Claims, 9 Drawing Sheets

HEAD AND OVERHEAD CAMSHAFT ASSEMBLY FOR AN INTERNAL COMBUSTION ENGINE

CROSS REFERENCE TO RELATED APPLICATIONS

This application claims the benefit under Title 35, U.S.C. §119(e) of U.S. Provisional Application Ser. No. 60/016,262, filed Apr. 24, 1996.

1. Field of the Invention

The present invention pertains to small engines and in particular to overhead camshaft, single cylinder, internal combustion engines of a size and type adapted for use in power equipment such as lawnmowers, garden tillers, and the like.

2. Background of the Invention

Single cylinder, overhead camshaft, four-cycle, internal combustion engines have been used to power outdoor equipment such as garden tillers, lawnmowers, small tractors, and the like. A typical single cylinder, overhead camshaft, four-cycle engine includes an engine block having a cylinder bore, a cylinder head at the top of the bore, and a crankcase housing at the bottom of the bore. A camshaft cover is typically fastened to the head, and the volume inside the camshaft cover between the head and the cover provides a camshaft cavity. Two or more of these main components of the engine block may be integrally formed with each other. Alternatively, any one or more of these components may be formed from separate elements.

Inside the crankcase housing, a crankshaft is rotatably housed and is coupled to a piston by a connecting rod. A cylinder bore houses the piston and the volume of the bore between the top of the piston and the cylinder head functions as a combustion chamber. The head includes intake and exhaust ports for allowing the fuel/air charge to enter, and exhaust gases to leave, the combustion chamber. The intake and exhaust ports are opened and closed by intake and exhaust valves, which are housed in the camshaft cavity and extend into the combustion chamber. Also, in the camshaft cavity, a camshaft is rotatably mounted for actuating the valves during engine operation. In one kind of design, lobes on the camshaft directly contact and actuate the valves during engine operation. In another kind of design, the lobes on the camshaft actuate rocker arms which then in turn contact and actuate valves during engine operation. Typically, a camshaft in a single cylinder engine has two lobes, one of which controls the intake valve assembly, and another which controls the exhaust valve assembly. A multi-lobe cast or forged camshaft can be expensive to produce for it requires multiple machining steps. Further, its shape does not lend itself well to the use of relatively inexpensive manufacturing methods such as powdered metal sintering or to simple plastic injection mold techniques.

The camshaft may be coupled to the rotating crankshaft by an endless loop driver, such as a timing belt or timing chain, trained over pulleys or sprockets mounted on the corresponding axial ends of the shafts. The endless loop driver transmits the rotational power of the rotating crankshaft to the camshaft, causing the camshaft to rotate in a timed manner. In overhead camshaft engines of this design, the endless loop driver is installed after the head is assembled to the cylinder block, and then, generally, after the camshaft and its sprocket are assembled to the head.

A shortcoming of overhead camshaft, single cylinder engines concerns the proper adjustment of the valves during engine manufacture. In previously known engines, the amount by which the valves are allowed to open is set, or lashed, on the main assembly line after the head, valves, rocker arms, camshaft, sprockets and timing chain have been fully assembled to the engine block on the main assembly line. However, setting valve lash is relatively time consuming. When valve lash is set on the main assembly line, it is typically the rate limiting manufacturing step which actually paces the speed of the line. In such cases it is desirable to avoid having to accomplish valve lashing on the main assembly line. Moreover, space constraints within the engine may make it desirable to employ an short endless loop driver, which has little slack to be taken up by tensioners. Such a short endless loop driver may not be installed onto pulleys or sprockets already assembled to the camshaft assembly. In overhead cam engines having such space constraints, there is a great need to accommodate the easy installation of this type of endless loop driver in an overhead camshaft engine after installation of the camshaft.

SUMMARY OF THE INVENTION

The present invention provides an overhead cam, single cylinder, four cycle, internal combustion engine of the general type described above, having a structure which allows the cylinder head, the valve assemblies, rocker arms and camshaft to be fully preassembled off the main assembly line, including setting of the valve lash. One aspect of the present invention is the use of a slanted head to expose one end of the camshaft to provide easy installation of the camshaft sprocket and timing chain. The inventive head has sidewalls which form a top perimeter along their top sides. The top perimeter forms a plane which is oriented at an angle to the longitudinal axis of the camshaft such that the sidewall proximal to the end of the camshaft upon which its sprocket attaches does not obstruct that end of the camshaft. Further, the sidewalls are arranged such as to allow the camshaft sprocket, with the timing chain trained over it, to be easily assembled to the end of the previously-installed camshaft and secured thereto with a screw or bolt. The slanted head perimeter is also advantageous in engine designs where the camshaft bearings are integral with the head and the camshaft has to be axially inserted in place. A camshaft cover having a bottom perimeter corresponding to the top perimeter of the cylinder head is fastened to the cylinder head such that the bottom perimeter of the cover is sealingly coupled to the top perimeter of the cylinder head such as to enclose the camshaft, its bearings, the valve assemblies, rocker arms and timing chain sprocket.

While the above-described aspect of the invention contemplates its being used in conjunction with a multi-lobe camshaft, another aspect of the present invention further provides the use of a single-lobe camshaft, which generally requires fewer machining steps and is better adapted to alternative manufacturing methods, such as simple plastic injection mold techniques and powdered metal sintering.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
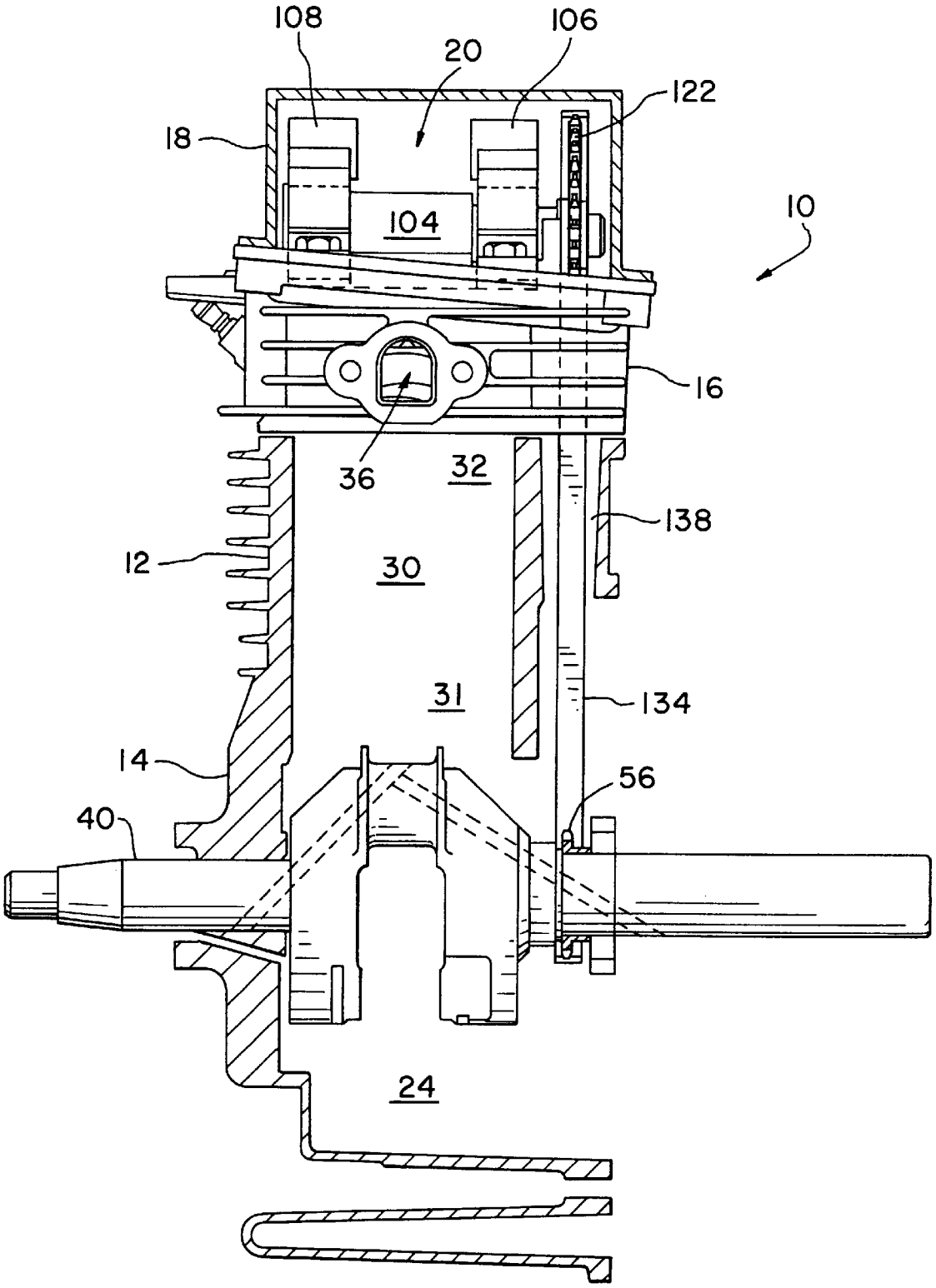
FIG. 1 is a diagrammatic partial side view in partial cross-section of an internal combustion engine configured according to the principles of the present invention.

Corresponding reference characters indicate corresponding parts throughout the several views. Although the drawings represent an embodiment of the present invention, the drawings are not necessarily to scale and certain features may be exaggerated in order to better illustrate and explain the present invention. The exemplification set out herein illustrates an embodiment of the invention in one form, and such exemplification is not to be construed as limiting the scope of the invention in any manner.

DETAILED DESCRIPTION OF THE INVENTION

The various aspects of the present invention will now be described with reference to the particular four stroke cycle, overhead cam, single cylinder internal combustion engine partially shown in FIG. 1. However, the embodiment disclosed below is not intended to be exhaustive or limit the invention to the precise form disclosed in the following detailed description.

Referring to FIG. 1, there is partially shown a horizontal crankshaft type internal combustion engine, generally designated 10, configured in accordance with the present invention. While the horizontal crankshaft orientation shown in the figures finds beneficial application in a variety of devices, engine 10 could be otherwise arranged and oriented. For example, alternative engine embodiments provided with crankshafts of other orientations, e.g., a vertically oriented crankshaft, would still be within the scope of the invention.

As shown in the figures, the housing of engine 10 is formed in part by an engine block comprising a cylinder barrel 12 and a crankcase housing having a cover 14, and cylinder head 16. In the preferred embodiment, the engine block and cylinder head 16 are separate components which may be secured together by any suitable fastening means. As one example of such a fastening means, cylinder head 16 is fastened to cylinder barrel 12 by fastening bolts or screws (not shown). Engine 10 also includes cam cover 18, which is secured to cylinder head 16 by suitable fastening means such as fastening bolts (not shown) or the like. The volume inside cam cover 18, between cam cover 18 and cylinder head 16, defines camshaft chamber 20.

Figure 3:
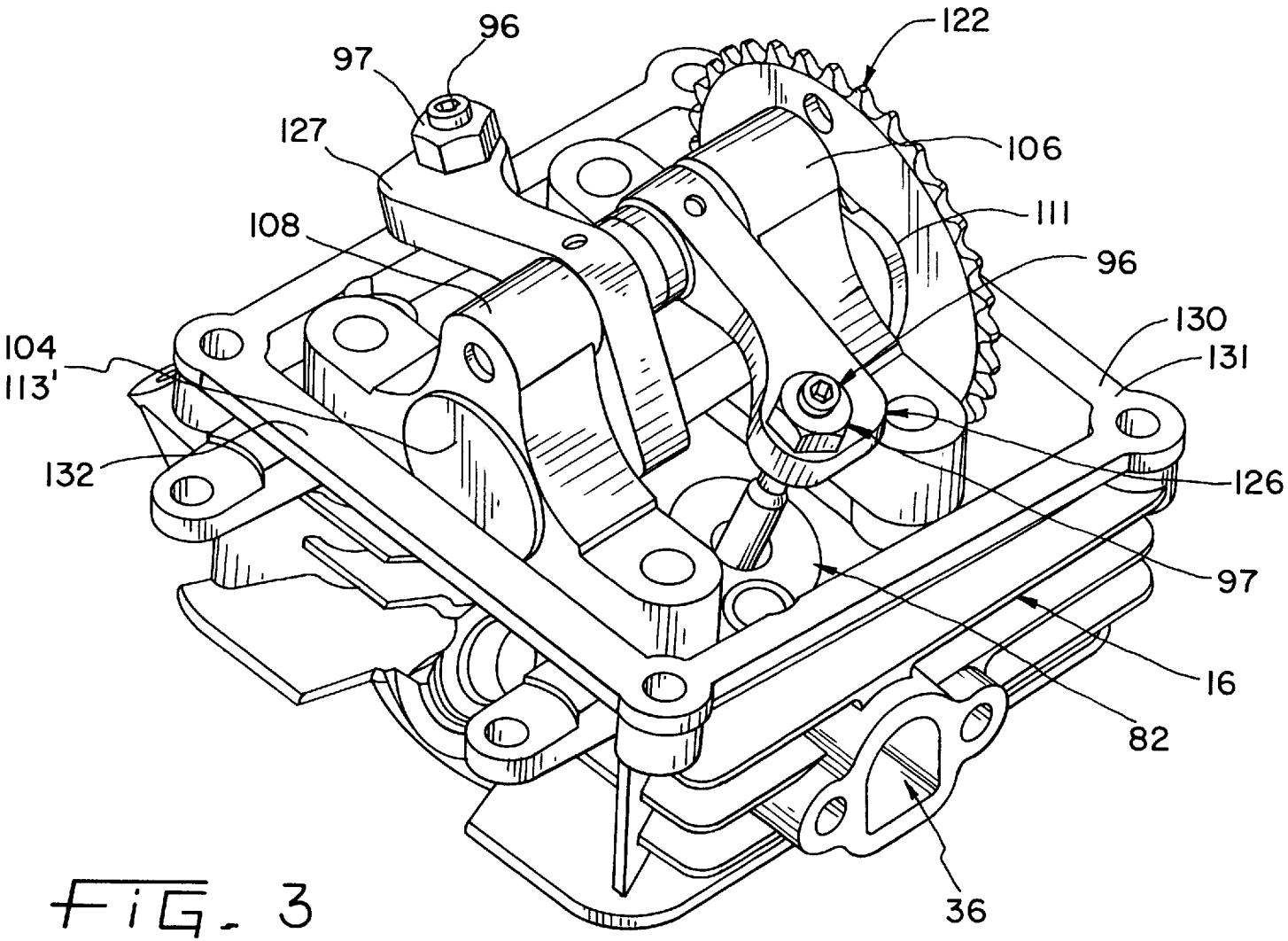
FIG. 3 is a perspective view of the assembled camshaft assembly and head of FIG. 2.
Figure 4:
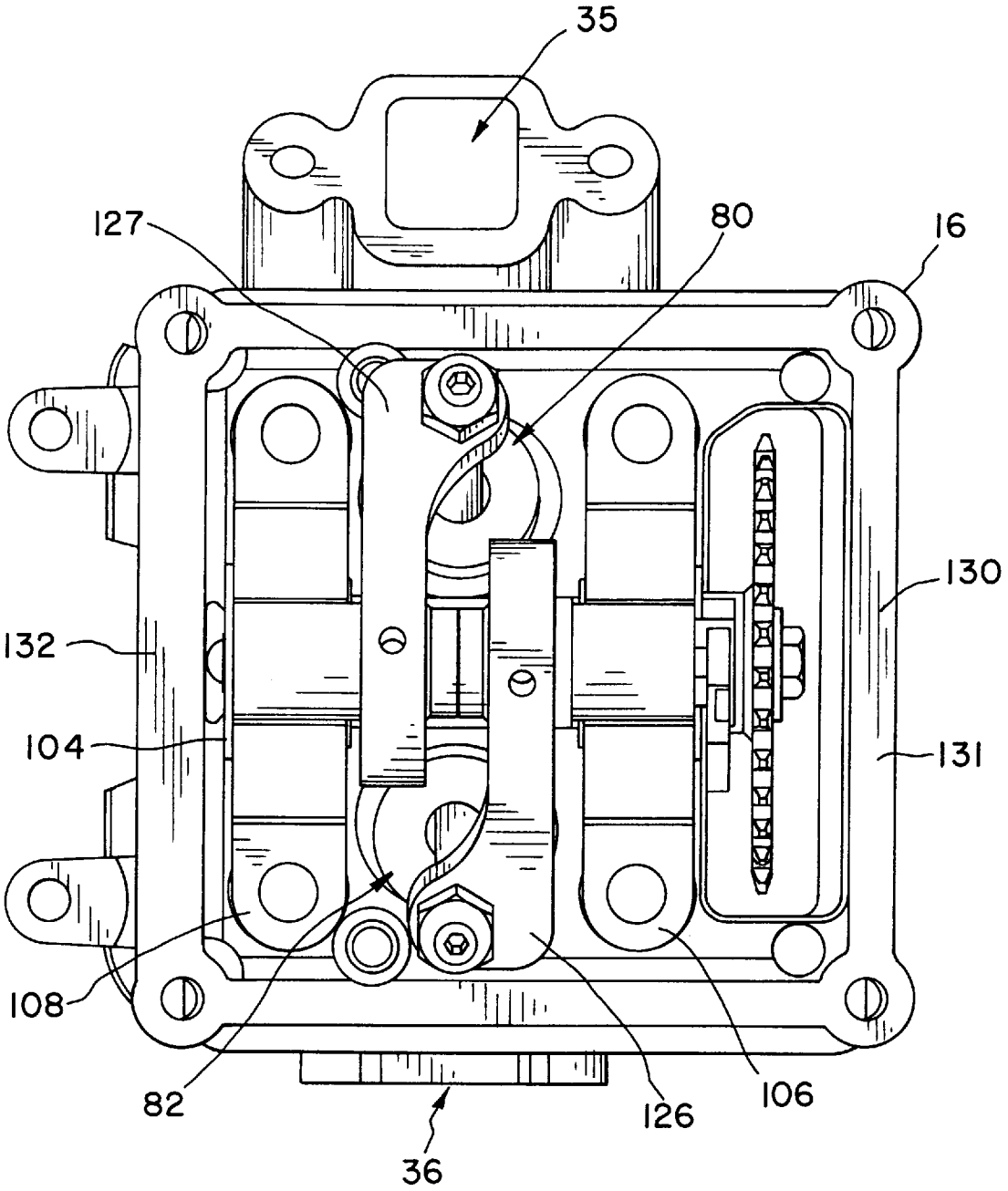
FIG. 4 is a plan view of the camshaft assembly and head of FIG. 3.
Figure 5:
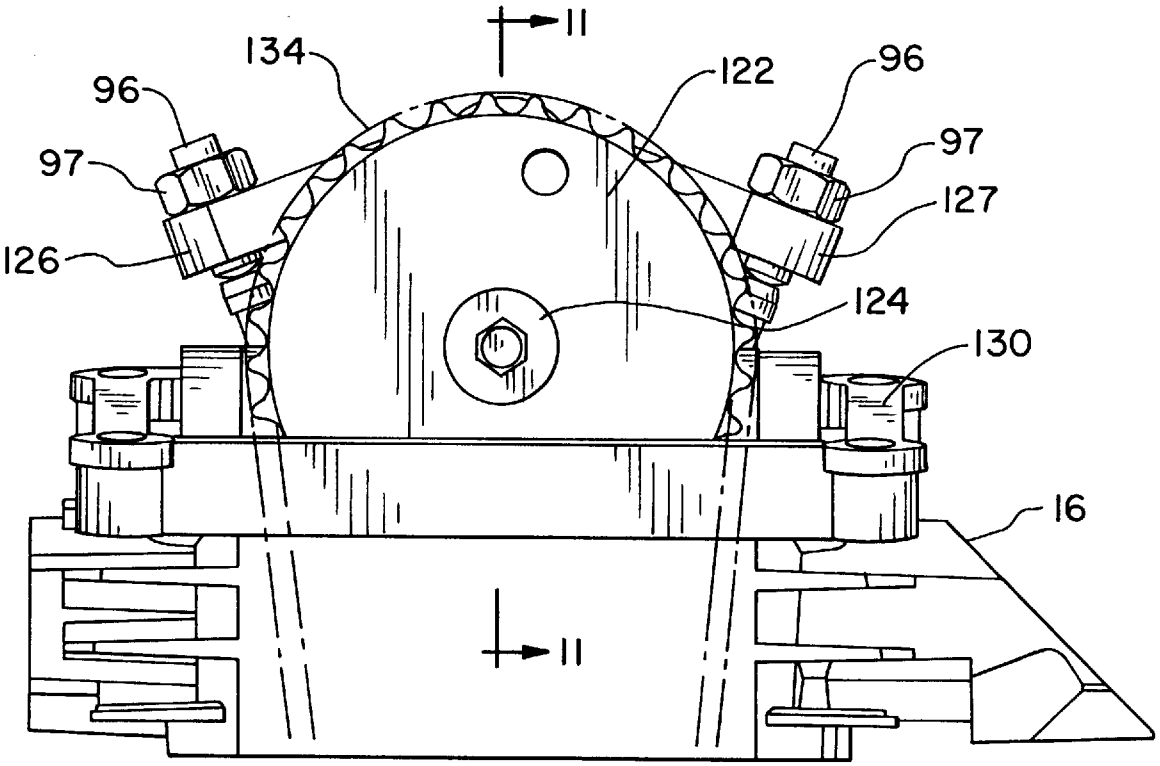
FIG. 5 is a front view of the camshaft assembly and head of FIG. 3.
Figure 7:
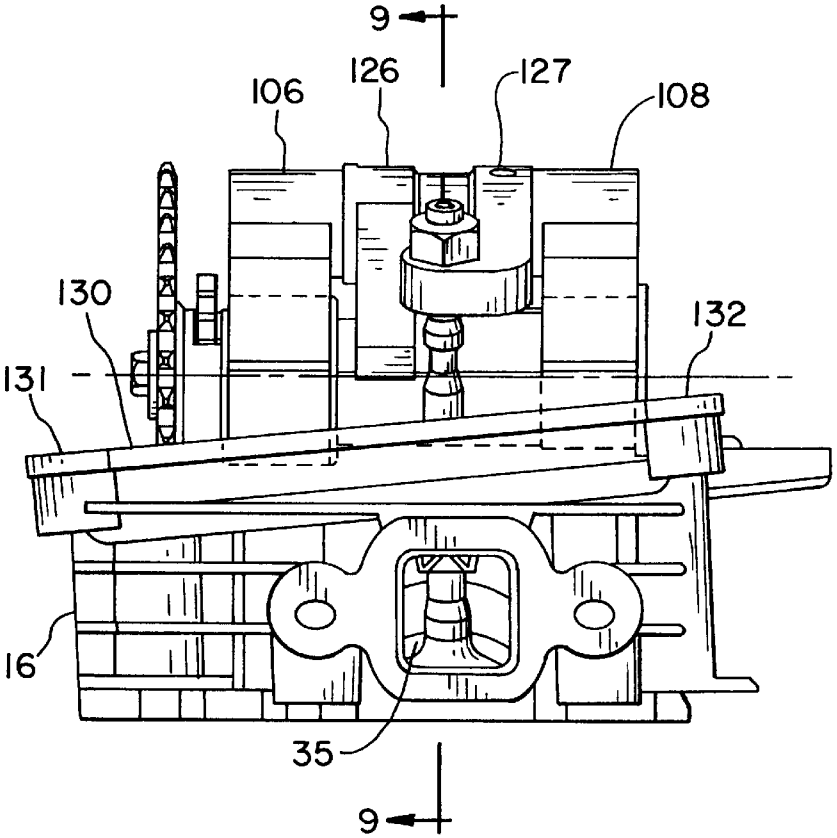
FIG. 7 is a side view of the camshaft assembly and head of FIG. 3 from the side opposite that of FIG. 6.
Figure 6:
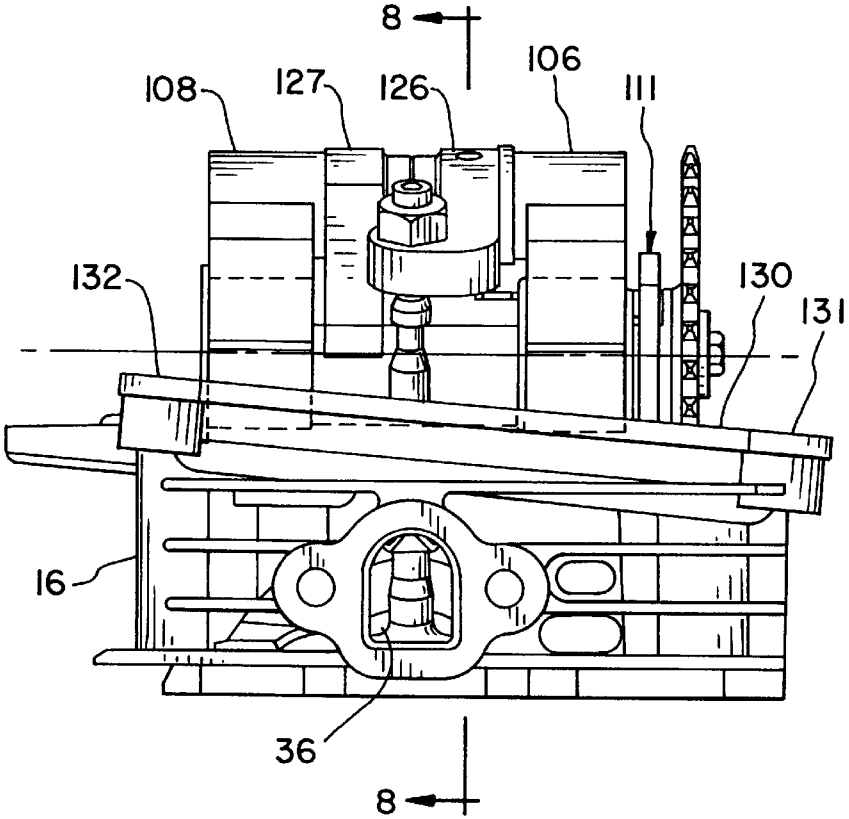
FIG. 6 is a side view of the camshaft assembly and head of FIG. 3.
Figure 8:
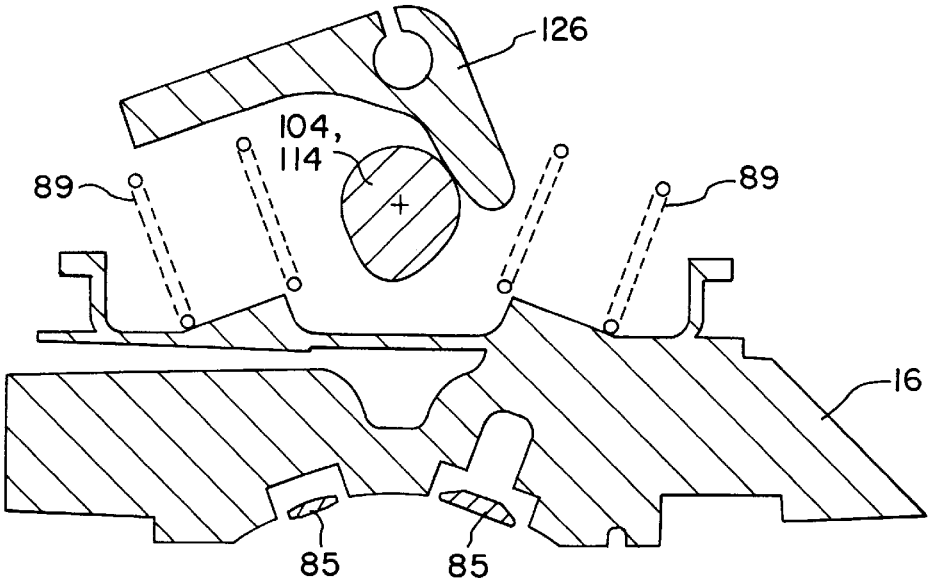
FIG. 8 is a partial sectional view along line 8—8 of FIG. 6.

As seen best in FIG. 1, cylinder barrel 12 is provided with cylinder bore 30 in which a piston (not shown) with associated rings (not shown) translates in a reciprocating fashion during engine operation. Cylinder bore 30 has a longitudinal axis which extends from bottom end 31 of cylinder barrel 12 to top end 32 of cylinder barrel 12. The volume within cylinder bore 30, between the piston and cylinder head 16, serves as the combustion chamber for engine 10. Intake port 35 (FIGS. 4, 7) and exhaust port 36 (FIGS. 3, 6) are provided in the cylinder head 16 in order to allow the fuel/air charge and exhaust gases to enter and leave the combustion chamber.

Referring again to FIG. 1, a crankshaft, generally designated 40, is rotatably journalled inside crankshaft cavity 24 upon cooperating journal bearings (not shown). Crankshaft 40 has a longitudinal axis normal to that of cylinder bore 30. Crankshaft 40 also includes a drive sprocket 56 which, as will be described in more detail below, transfers the rotational motion of crankshaft 40 to components of engine 10 which are housed in camshaft chamber 20. Crankshaft 40 is coupled to the piston by a connecting rod (not shown).

Cylinder head 16 supports intake valve assembly 80 and exhaust valve assembly 82 (FIGS. 9, 10) on valve seats 84 and 86 (FIG. 9), respectively. Valve assemblies 80 and 82 control flow communication of the fuel/air charges and exhaust gases with the combustion chamber by selectively opening and closing intake port 35 and exhaust port 36 during engine operations. As shown best in FIG. 9, intake valve assembly 80 comprises a valve having a cylindrical valve stem 88 and valve head 85 which is configured to be received by valve seat 84 in order to reversibly open and close inlet port 35. Compression spring 89 encircles valve stem 88 and bears against keeper retainer 90 for urging intake valve head 85 to its closed position. Exhaust valve assembly 82 includes a corresponding valve, compression spring, and keeper retainer. Valve assemblies 80 and 82 are assembled to head 16 off the main assembly line, before the camshaft and rocker arms are installed.

Figure 2:
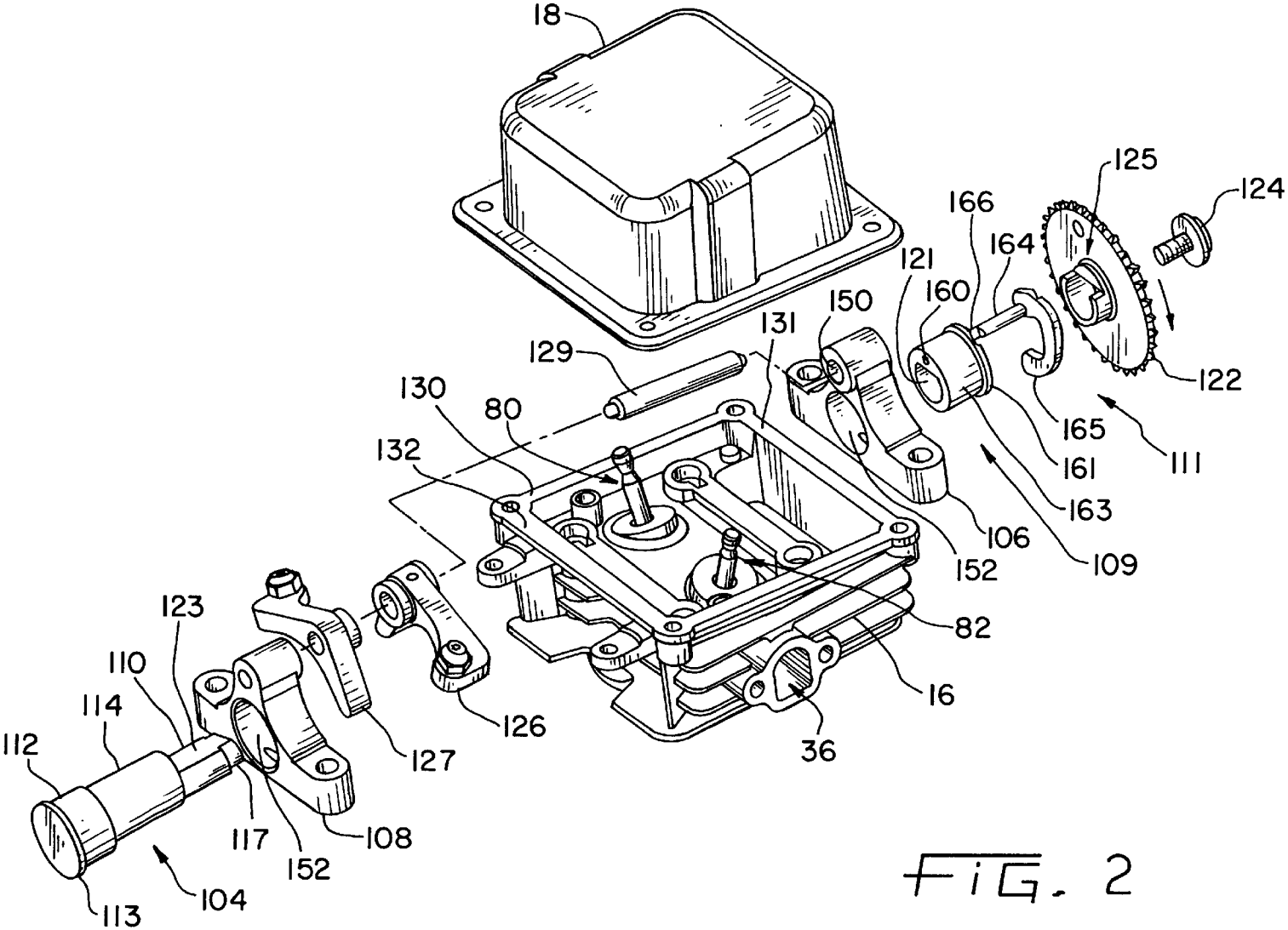
FIG. 2 is an exploded, perspective view of one embodiment of the camshaft assembly and head of the present invention.
Figure 10:
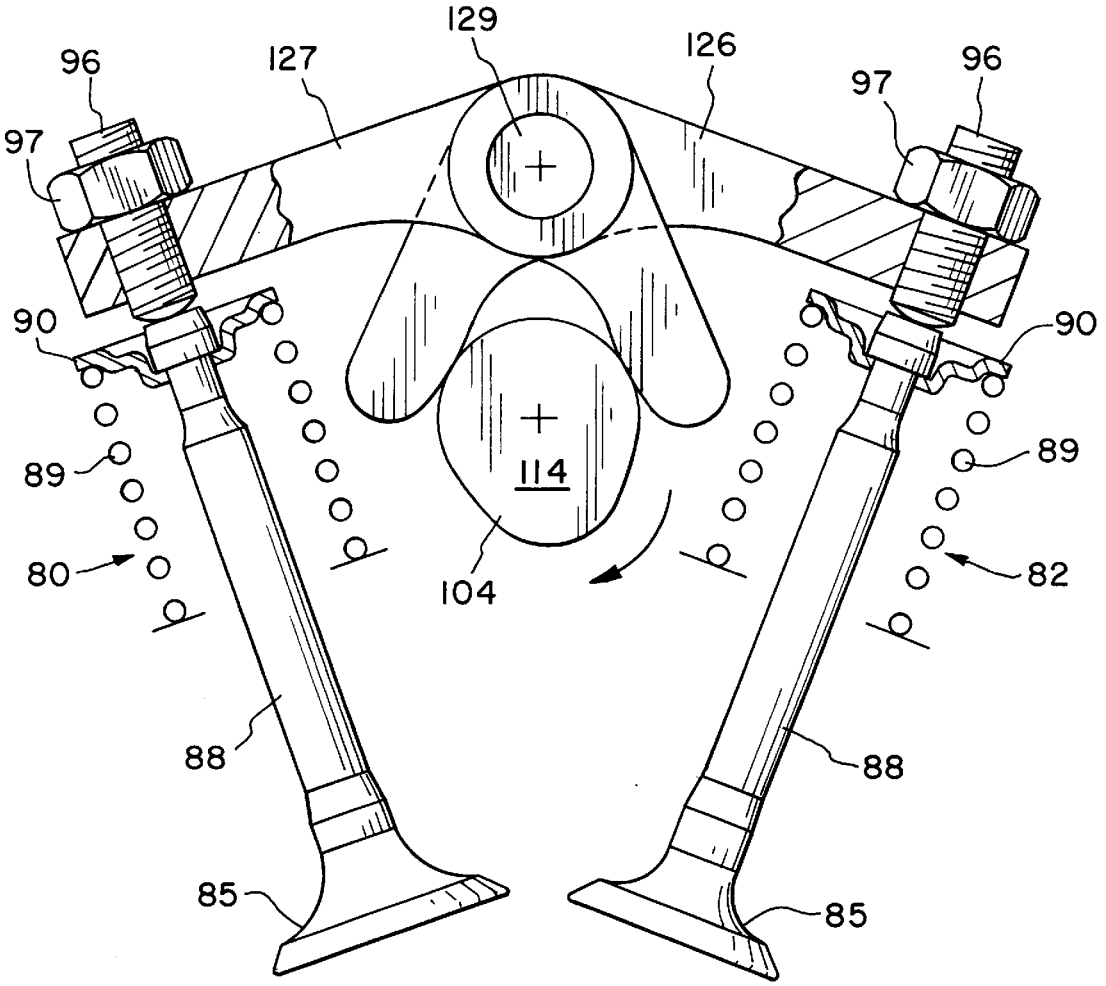
FIG. 10 is a partial rear view of the camshaft assembly.
Figure 11:
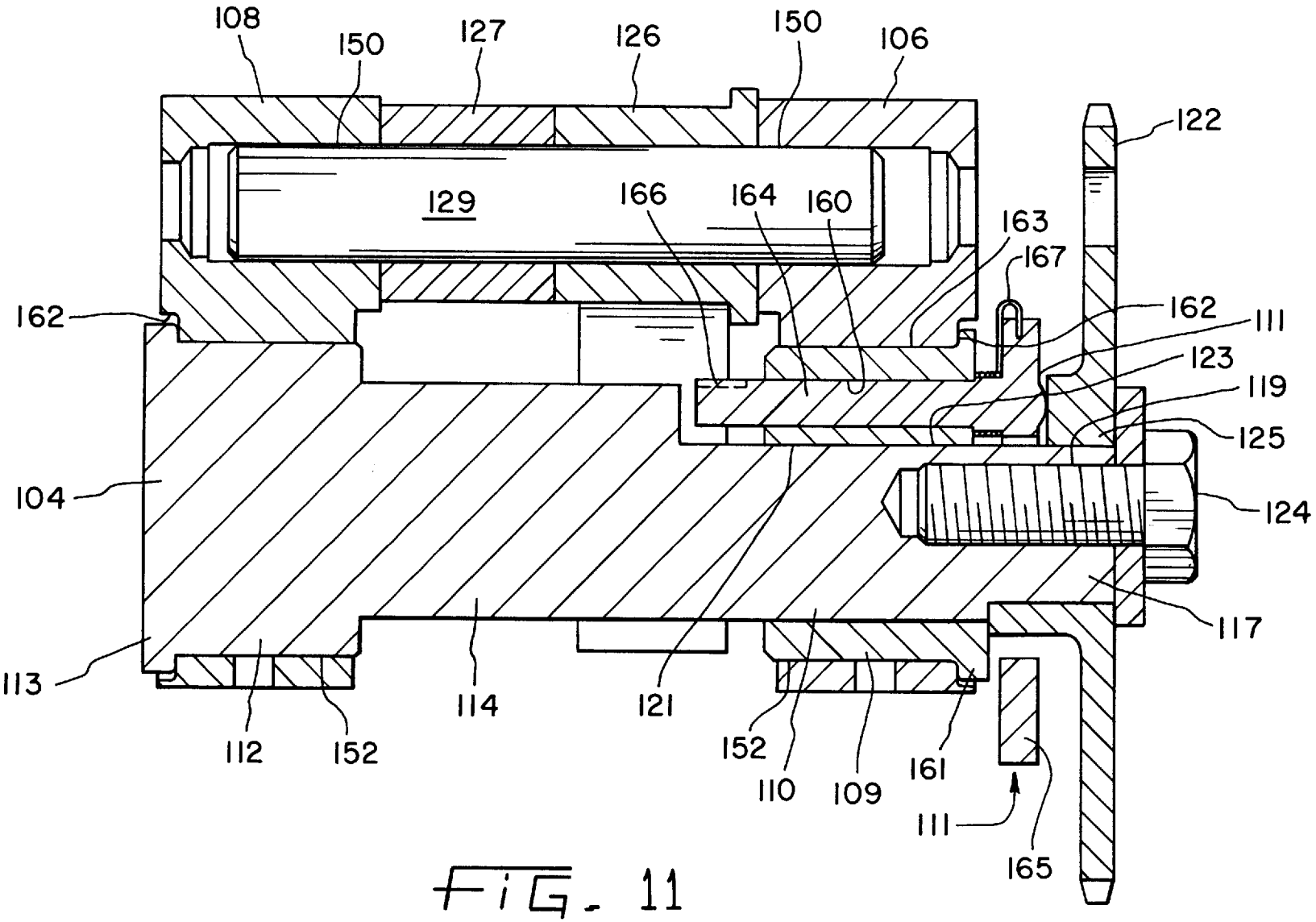
FIG. 11 is a partial sectional view of the camshaft assembly along line 11—11 of FIG. 5.

Within camshaft chamber 20 are cooperating camshaft pillow blocks 106 and 108 (FIGS. 2, 3), each having a pin bearing bore 150 and a journal bearing 152 (FIGS. 2, 11). Pillow blocks 106 and 108 are arranged such that their pin bearing bores face each other. Disposed within pin bearing bores 150 and extending between pillow blocks 106 and 108 is bearing pin 129 (FIGS. 2, 11) upon which rocker arms 126 and 127 are pivotally mounted, as shown in FIG. 10.

Overhead camshaft 104 has a longitudinal axis parallel that of crankshaft 40, and is disposed within journal bearings 152 of pillow blocks 106 and 108. At one axial end of camshaft 104 is a cylindrical thrust bearing portion 113, shown in FIGS. 2 and 11, which is of slightly larger diameter than the journal bearing diameter of pillow block 108, and is received in bearing relief 162 located on the side of pillow block 108 (FIG. 11). Adjacent and coaxial with thrust bearing portion 113 on camshaft 104 is large camshaft journal section 112, rotatably journalled within bearing 152 of pillow block 108. Cam lobe 114 of camshaft 104 is located adjacent and coaxial with large camshaft journal section 112, is disposed between pillow blocks 106 and 108, and directly actuates corresponding rocker arms 126 and 127, as shown in FIG. 10. Adjacent and coaxial with lobe 114 is small camshaft journal section 110 having a flat surface portion 123.

The preferred embodiment of camshaft 104, as shown in the accompanying drawings, has single lobe 114, although a multi-lobe camshaft having individual intake and exhaust lobes is contemplated in the present invention. Single lobe camshaft 104 may be formed in one piece from steel, aluminum, sintered powdered metal or a lightweight material such as a thermoset or thermoplastic polymer or a combination of one or more polymers. Such lightweight materials tend to produce less noise during engagement with the rocker arms and valve assemblies 80 and 82 than do heavier materials such as metal or the like. Use of polymeric materials, in particular, also allows ready provision of precisely molded camshaft with little or no machining required after molding. Alternative camshaft constructions including an assembly of component parts made from various materials may also be employed within the scope of the invention.

Cylindrical journal bushing 109 has through hole 121 which slidably receives small camshaft journal section 110 and correlates with flat surface portion 123 thereof. Bushing 109, having journal 163, is rotatably disposed within journal bearing 152 of pillow block 106. Thus, camshaft 104 is rotatably supported by pillow blocks 106 and 108. Bearing 109 has, adjacent and coaxial with journal 163, thrust bearing portion 161 of slightly larger diameter than the journal bearing diameter of pillow block 106 and oriented such that it is received in bearing relief 162 located on the side of pillow block 106 opposite cam lobe 114 (FIG. 11).

The structure of cylinder head 16 greatly facilitates pre-assembly of valve assemblies 80 and 82, and a camshaft assembly comprising pillow blocks 106 and 108, camshaft 104, bushing 109, pivot pin 129 and rocker arms 126 and 127 in the head, off the main assembly line. As mentioned above, valve assemblies 80 and 82 are assembled to head 16 before installation of the camshaft assembly. Following the loose assembly of camshaft 104, pin 129, rocker arms 126 and 127, bushing 109 and pillow blocks 106 and 108, the pillow blocks are fastened to head 16 with bolts (not shown) such that set screw 96 of rocker arm 126 corresponds to exhaust valve assembly 82 and set screw 96 of rocker arm 127 corresponds to intake valve assembly 80. Thus, one side of camshaft 104 contacts rocker arm 126, and its opposite side contacts rocker arm 127 (FIG. 10).

Unlike prior art engines which required valve lash to be set on the main assembly line, the present invention allows valve lash to be set during pre-assembly of the cylinder head components off the main assembly line. For example, according to the approach of the present invention, the position of set screw 96 controls the amount of valve lash between rocker arm 126 and valve assembly 82. During pre-assembly, a feeler gage is used to adjust set screw 96 to the position at which the proper amount of valve lash is accomplished. After adjusting set screw 96 to the proper position, lock nut 97 is tightened to retain the screw 96 in place. A similar technique is used to adjust set screw 96 and lock nut 97 in rocker arm 127. Advantageously, the present invention, by permitting valve lash to be set off the main assembly line, allows the main assembly line to be run at greater speeds in cases where the main assembly line speed would otherwise be rate limited by valve lashing step.

Referring again to FIG. 1, crankshaft drive sprocket 56 and camshaft sprocket 122 are interconnected by an endless loop driver, such as timing chain 134, which is mounted inside the engine block. Timing chain 134 transmits rotational motion from crankshaft 40 to camshaft 104 and achieves the timed relation therebetween necessary for proper engine operation. Timing chain 134 travels upward from drive sprocket 56 toward camshaft sprocket 122 and downward again through chain cavity 138.

The slanted head design of the present invention allows camshaft sprocket 122 and timing chain 134 to be installed on the main assembly line after attachment of the pre-assembled head and camshaft assembly, in which the valves have been lashed, to the engine block. As seen best in FIGS. 6 and 7, top perimeter 130 of cylinder head 16 is slanted relative to the longitudinal axis of camshaft 104. Top perimeter 130 slants downward from an inboard side 132 to an outboard side 131 such that the head does not obstruct the end of camshaft 104 driven by camshaft sprocket 122. This configuration allows sprocket 122, over which timing chain 134 has been trained, to be assembled to the end of camshaft 104. Referring to FIGS. 2 and 11 it can be seen that at the axial end of camshaft 104 opposite thrust bearing portion 113 is sprocket engaging portion 117, which shares flat surface portion 123 with small journal section 110. Sprocket 122 has a hub section 125 correlating to the cross section of engaging portion 117 and is slidably mounted thereto. Sprocket 122 is retained to camshaft 104 by screw and washer 124, threadedly engaged into camshaft screw hole 119. Thus, the present invention provides a way of assembling a short timing chain to a pre-assembled camshaft assembly in which valves may be lashed off the main assembly line.

Figure 9:
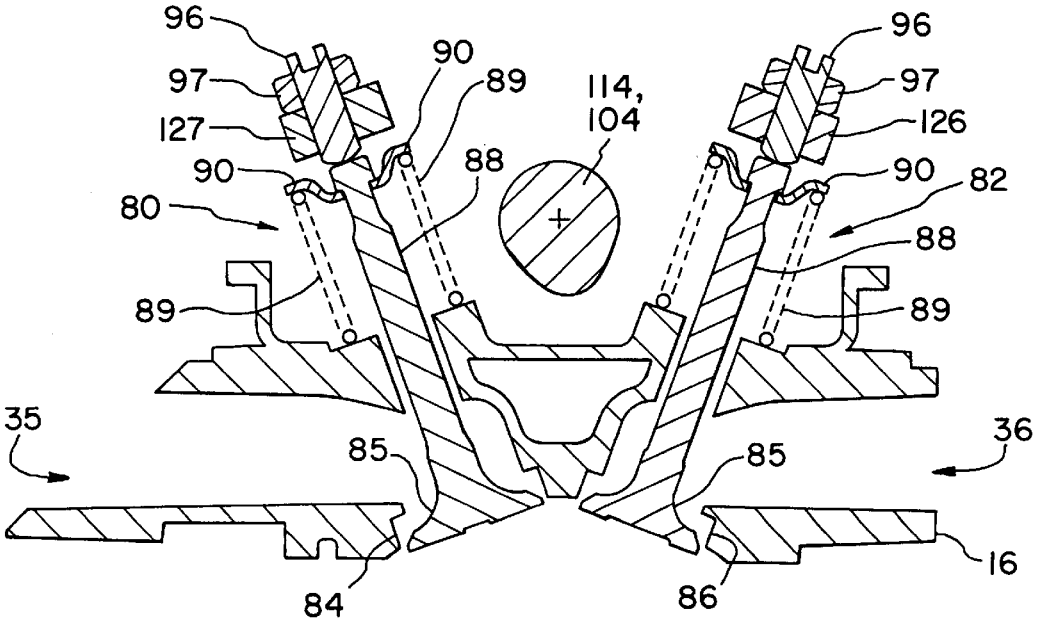
FIG. 9 is a partial sectional view along line 9—9 of FIG. 7.

Embodiments of the present invention may also incorporate mechanical compression release mechanism 111 (FIG. 2), comprising rotating pin 164 and flyweight 165, intended to reduce cylinder pressure for easy engine starting. Mechanism 111 is installed after setting valve lash and prior to installation of sprocket 122. In such embodiments, bushing 109 has a passage 160, parallel to the longitudinal axis of camshaft 104, located between the portion of hole 121 correlating with flat surface portion 123 of camshaft 104 and journal 163 (FIG. 11). Pin 164 is disposed in passage 160 and is fixed at one axial end to flyweight 165, shown in FIG. 2 as adapted to partially encircle sprocket hub 125 and sprocket engaging portion 117 of camshaft 104. At the other axial end of pin 164 is a auxiliary cam 166 (FIG. 11) adapted to extend above the surface of lobe 114 to engage rocker arm 126 in a first position, in response to low engine speed, preventing head 85 of exhaust valve assembly 82 from fully seating into valve seat 86 (FIG. 9). Pin 164 is rotated to a second position in response to high engine speed whereby auxiliary cam 166 is adapted so as not to engage rocker arm 126, allowing rocker arm 126 to continuously follow lobe 114 and exhaust valve head 85 to fully seat into valve seat 86. Pin 164 is rotated by means of centrifugally activated flyweight 166 in response to engine speed and is biased to the first position, corresponding to low engine speed, by resilient coil spring 167 (FIG. 11). Spring 167 is disposed around pin 164 with one end extending out and bearing against flyweight 166 and the other end extending out and bearing against camshaft 104 in the area near sprocket engaging portion 117.

What is claimed is:

1. In an overhead cam engine, a head and camshaft assembly comprising:

a head having sidewalls defining a camshaft assembly chamber, said walls terminating in an upper perimeter lying in a first plane; and a camshaft mounted in said chamber for rotation about an axis;

said first plane defined by said upper perimeter being slated so as to form an acute angle with the camshaft axis of rotation thereby disposing an end of said camshaft above one of said sidewalls.

2. The overhead cam engine of claim 1, including a cover disposed upon said upper perimeter of said head, said cover and sidewalls enclosing said chamber.

3. The overhead cam engine of claim 1, including a sprocket and timing chain, wherein said timing chain is trained over said sprocket and said sprocket is engaged to said end of camshaft disposed above said sidewall.

4. The overhead cam engine of claim 3, wherein said sprocket is fastened to said end of camshaft.

5. The overhead cam engine of claim 3, wherein said sprocket is disposed within said upper perimeter.

6. The overhead cam engine of claim 1, further comprising:

a plurality of valve assemblies and a plurality of substantially L-shaped rocker arms disposed such that one end of each of said rocker arms is biased to slidably engage said camshaft on one side of a fixed second plane in which said camshaft axis of rotation lies, and the other end of a each of said rocker arms engages a said valve assembly located on the other side of said second plane.

7. The overhead cam engine of claim 6, wherein said camshaft has a single lobe.

8. The overhead cam engine of claim 6, including a mechanical compression release means adapted to rotate with said camshaft to prevent one of said valve assemblies from seating while said compression release means is in a first position and to allow said valve assembly to seat while said compression release means is in a second position, said first position corresponding to low engine speeds and said second position corresponding to high engine speeds, said compression release means biased to said first position.

9. The overhead cam engine of claim 7, wherein said camshaft is substantially disposed between the extreme ends of each said rocker arm.

10. The overhead cam engine of claim 7, wherein said rocker arms are pivotally mounted on a common axis parallel to said camshaft axis of rotation.

11. The overhead cam engine of claim 7, including a mechanical compression release means adapted to rotate with said camshaft to prevent one of said valve assemblies from seating while said compression release means is in a first position and to allow said valve assembly to seat while said compression release means is in a second position, said first position corresponding to low engine speeds and said second position corresponding to high engine speeds, said compression release means biased to said first position.

12. The overhead cam engine of claim 6, wherein said camshaft is substantially disposed between the extreme ends of each said rocker arm.

13. The overhead cam engine of claim 6, wherein said rocker arms are pivotally mounted about a common axis parallel to said camshaft axis of rotation.

14. A camsbaft assembly in an overhead cam engine having a piston which reciprocates within a cylinder, comprising:

a camshaft extending above the cylinder and having an axis of rotation and a single lobe; and at least a pair of overlapping rocker arms, said rocker arms pivotally mounted about a common axis parallel to said camhaft axis of rotation, each of said rocker arms being disposed such that one end of each of said rocker arms is biased to slidably engage said camshaft on one side of a fixed plane in which said camshaft axis of rotation lies, and the other end of said of each of said rocker arms engages a valve assembly located on the other side of said plane.

15. A camshaft assembly according to claim 14, wherein said camshaft is disposed between the extreme ends of each said rocker arm.

16. A camshaft assembly according to claim 14, including a mechanical compression release means adapted to rotate with said camshaft to intermit the continuous sliding engagement of one of said rocker arms upon said lobe while said compression release means is in a first position and to allow continuous sliding engagement of said rocker arm upon said lobe while said compression release means is in a second position, said first position corresponding to low engine speeds and said second position corresponding to high engine speeds, said compression release means biased to said first position.

17. A camshaft assembly in an overhead cam engine, comprising:

a camshaft having an axis of rotation and a single lobe; and a plurality of L-shaped rocker arms, said rocker arms pivotally mounted about a common axis parallel to said camshaft axis of rotation, each of said rocker arms being disposed such that one end of each of said rocker arms is biased to slidably engage said camshaft on one side of a fixed plane in which said camshaft axis of rotation lies, and the other end of said each of said rocker arms engages a valve assembly located on the other side of said plane, said camshaft substantially disposed between two of said valve assemblies.

18. A camshaft assembly according to claim 17, wherein said camshaft is disposed between the extreme ends of each said rocker arm.

19. A camshaft assembly according to claim 17, including a mechanical compression release means adapted to rotate with said camshaft to intermit the continuous sliding engagement of one of said rocker arms upon said lobe while said compression release means is in a first position and to allow continuous sliding engagement of said rocker arm upon said lobe while said compression release means is in a second position, said first position corresponding to low engine speeds and said second position corresponding to high engine speeds, said compression release means biased to said first position.

* * * * *